United States Patent [19]

Feinberg

[11] Patent Number: 4,637,087

[45] Date of Patent: Jan. 20, 1987

[54] SWIMMING POOL CLEANER ATTACHMENT

[76] Inventor: Andrew S. Feinberg, 4971 Vista Del Monte, El Paso, Tex. 79922

[21] Appl. No.: 770,925

[22] Filed: Aug. 30, 1985

[51] Int. Cl.[4] ..... E04H 3/20

[52] U.S. Cl. ..... 15/1.7; 15/246; 15/257 R; 15/160

[58] Field of Search ..... 15/1.7, 160, 246, 257 R

[56] References Cited

U.S. PATENT DOCUMENTS

| | | | |
|---|---|---|---|
| 2,243,576 | 5/1941 | Otto | 15/160 |
| 3,003,168 | 10/1961 | Shouldice | 15/1.7 |
| 3,402,413 | 9/1968 | Gibellina | 15/246 X |
| 3,795,027 | 3/1974 | Lindberg, Jr. | 15/1.7 X |

FOREIGN PATENT DOCUMENTS

| | | | |
|---|---|---|---|
| 1068216 | 11/1959 | Fed. Rep. of Germany | 15/160 |

*Primary Examiner*—Peter Feldman

*Attorney, Agent, or Firm*—Pollock, Vande Sande & Priddy

[57] ABSTRACT

A water foil is attached to a swimming pool brush or vacuum cleaning head. The foil has a check valve structure (one-way valve) incorporated therein so that the foil urges a cleaning device against a swimming pool surface when pushed down through the water while presenting a minimum surface area during an upward stroke, thereby increasing the efficiency of a pool cleaning operation.

8 Claims, 6 Drawing Figures

16
18
30
28
28
49
30
56
44
36
38
20
40
42
49
28
26
24
22

SWIMMING POOL CLEANER ATTACHMENT

FIELD OF THE INVENTION

The present invention relates to swimming pool cleaning devices, such as brushes and vacuum cleaners, and more particularly to a foil attachment for guiding such devices along a swimming pool wall.

BRIEF DESCRIPTION OF THE PRIOR ART

Periodically, it becomes necessary to clean the walls of swimming pools from accumulated coatings of organic matter, such as algae in addition to dirt and scum. In order to clean the walls of such accumulations, the wall surfaces must be periodically and frequently cleaned by manual scrubbing of the surface with a stiff bristled brush. Long poles are attached to a brush to enable an operator to extend the brush to the bottom of the pool walls, typically 10–15 feet below the water surface.

For similar reasons, it is also necessary to clean the pool bottom; and this is often done with a vacuum cleaning device. An elongated pole is employed to reach the floor of the pool.

To clean underwater surfaces, a substantial physical force must be exerted since the operator must manipulate the brush by moving the pole about. The deeper the brush or vacuum cleaning device is submerged, the more difficult it is for the operator to manipulate the cleaning device. In addition, a brush must be forced against the surface of a pool wall in order to clean the wall. Brushing vertical walls is particularly difficult because the operator must stand at the edge of the pool and continually force the brush against the pool wall. This type of cleaning operation is inherently tiresome and requires substantial strength.

The prior art has addressed this difficulty by suggesting the use of planes or foils attached to a brush or pole for exerting force against the brush as it is moved through the water in the pool. Characteristically, these prior art solutions have resulted in very inefficient force-producing schemes. The utilization of a simple wing or surface provides force against the brush when the brush is urged in its downward stroke; however, at the bottom of the downward stroke, the operator must control the brush in its upward stroke with very little leverage since the brush handle has been extended into the pool a substantial length. When the brush is withdrawn, the wing or plane used to produce force on the brush causes the brush to swing wildly outwardly toward the center of the pool away from the wall. To overcome this difficulty, pivoted planes have been used which cause the plane to pivot when the direction of the brush is changed, as shown in U.S. Pat. No. 3,003,168, which issued on Oct. 10, 1961 to Shouldice. The principal difficulty with such solutions is that the brush is forced against the wall during its upward as well as downward stroke. The upward movement of the brush does not accomplish the purpose of the brushing the walls, viz., to move the dirt downwardly toward the drain in the bottom of the pool.

U.S. Pat. No. 3,402,413, which issued Sept. 24, 1968, to Gibellina proposes an improved foil wherein a brush guide is mounted above the brush and includes three surfaces. The first is a leading edge surface which provides initial guidance to the brush in its downward stroke. The leading edge surface extends from a guide surface which is the principal guiding surface for directing the brush and pole as it is moved. The third surface extends from the guide surface and, in the embodiment chosen for illustration, comprises a curved portion extending away from the handle and terminating in a position having a tangent approximately perpendicular to the brush handle. Sides extending perpendicular to both the guide surface and the force-producing surface connect the two surfaces to form a partial enclosure to prevent water spillage over the side edges of the guide. The problem with this prior art device is that the guide offers a substantial water-resistant surface when a pool brush is pulled in the upward direction.

BRIEF DESCRIPTION OF THE PRESENT INVENTION

The present invention is an improvement over the prior art devices and basically includes a foil having a check valve (one-way valve) device incorporated within the foil. As a result, the foil of the present invention urges an attached cleaning device, such as a brush or vacuum cleaner, toward a surface to be cleaned when pushed down against water-resistance forces; but when pulled up, the check valve opens to decrease the surface area presented by the foil. This is advantageous because the foil would otherwise urge an attached cleaning device toward a wall to be cleaned as discussed in connection with the prior art. Thus, the present invention offers the advantage of assisting operation of a cleaning device during manual pushing of a device pole down into the pool; and upon pulling the pole up, the check valve structure eliminates interference by the foil and makes upward movement of the pole easy.

In a first embodiment of the invention, two rows of openings are formed in a foil and two elastomeric flaps are employed to respectively cover each row of openings. In a second embodiment of the invention, a single flap is centrally fastened between the two rows of openings and each half of the flap selectively covers a respective row of openings during operation of the invention.

The present invention is simply fastened to a swimming pool pole that mounts a scrub brush or vacuum cleaning head. It is inexpensively fabricated and greatly increases the efficiency of a pool-cleaning operation.

BRIEF DESCRIPTION OF THE FIGURES

The above-mentioned objects and advantages of the present invention will be more clearly understood when considered in conjunction with the accompanying drawings, in which.

DETAILED DESCRIPTION OF THE PRESENT INVENTION

Figure 1:
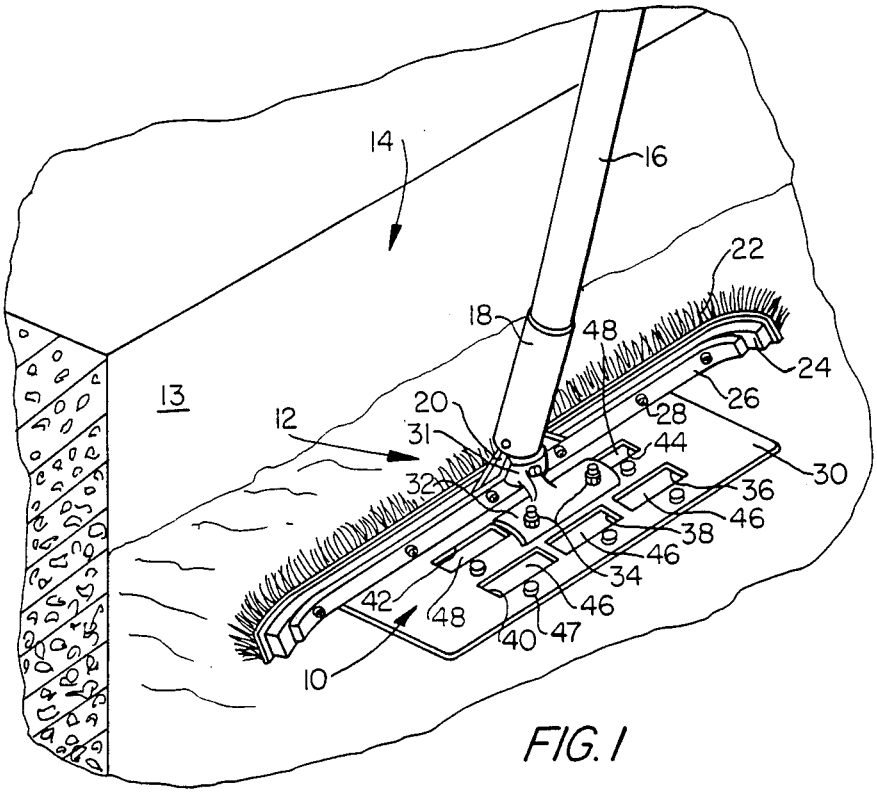
FIG. 1 is a perspective view illustrating the utilization of a first embodiment of the present invention.

FIG. 1 illustrates a first embodiment of the invention and is seen to include a water foil assembly 10 attached to a swimming pool brush, generally indicated by reference numeral 12. The device of FIG. 1 is illustrated against the wall 13 of a swimming pool, generally indicated by reference numeral 14. The foil assembly 10 and brush 12 are mounted to a pole by means of a connection collar 18 and laterally extending brace flanges 20. When using the device illustrated in FIG. 1, pole 16 is urged against the wall 13 of the swimming pool by a user of the device as the wall is scrubbed. The purpose of foil 10 is to compensate for water-resistance forces that tend to move the brush 12 away from the wall as the brush is pushed down.

The conventional brush 12 is seen to include nylon bristles 22 received within flexible strip 24. A metal backing strip 26 is connected to the flexible strip 24 by means of suitable fasteners 28 and rigidifies the brush structure. The foil 10 is seen to include a generally rectangular plate 30 which may be fabricated from any suitable material such as aluminum or plastic, such as polyurethane. The plate 30 is attached to collar 18 by a web 31 that extends outwardly to a connection plate 32, the latter being secured to plate 30 by means of suitable fasteners 34.

A first row of three rectangular openings 36, 38 and 40 lie in generally parallel relationship to a second row of two openings 42 and 44. As will be more clearly shown in FIG. 2 in a first embodiment of the invention, the reverse side of plate 30 has two generally rectangular flexible flaps 46 and 48 which respectively cover the first row and second row of openings. The flaps are secured to the plates by means of suitable fasteners 47. The combination of flaps 46, 48 and the openings which they cover functions as a check valve (one-way valve). To better understand this operation, reference is again made to FIG. 1 wherein the flaps 46, 48 are located on the underside of the foil plate 30. When the pole 16 is pushed down, thereby pushing displaced dirt toward the pool drain, water resistance forces the flaps 46 and 48 against the openings so that maximum surface area for plate 30 is presented. The angle between pole 16 and plate 30 is an acute angle and the downward pushing of pole 16 simulates hydrofoil action wherein horizontal forces are transmitted by foil 10 to the brush structure thereby urging the brush against wall 13 of the swimming pool and increasing the efficiency of a cleaning operation. However, when the pole is pulled upward, flaps 46 and 48 uncover the rectangular openings that the previously covered. This causes water to flow through the openings thereby minimizing the surface area of the foil during an upstroke, thereby enabling relatively effortless upward motion of the brush in preparation for the next cleaning stroke.

Figure 2:
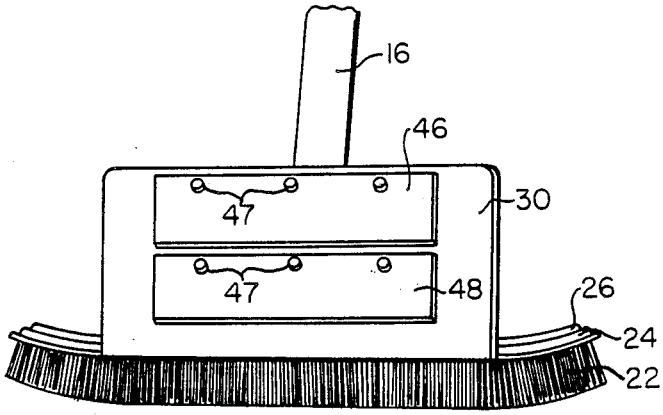
FIG. 2 is a perspective view of the device shown in FIG. 1 and removed from the environment of a swimming pool.
Figures 3, 4:
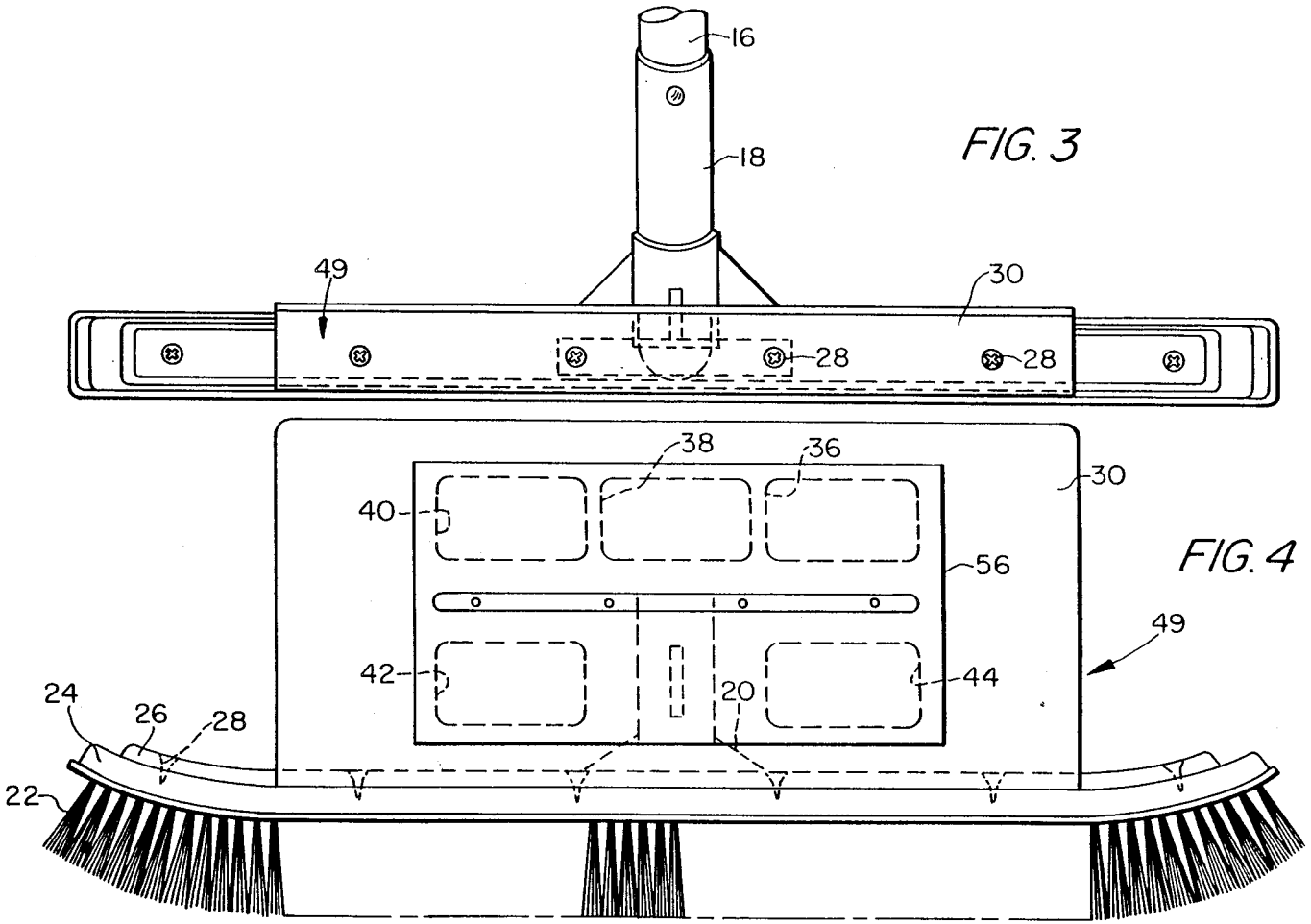
FIG. 3 is a top view of a second embodiment of the present invention.
FIG. 4 is a front view of a second embodiment of the present invention.
Figure 5:
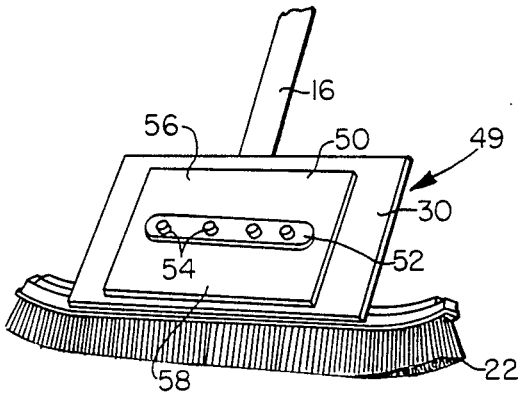
FIG. 5 is a perspective view of a second embodiment of the present invention.

FIGS. 3–6 illustrate a second embodiment 49 of the invention wherein a single flexible flap is centrally fastened to plate 30, as particularly shown in FIG. 5, to achieve the same function as discussed in connection with FIGS. 1 and 2 but with the advantage of lower fabrication cost. As seen in FIG. 5, the single flap 50 has a rigid strip 52 mounting a central portion of the flap to plate 30 by means of suitable fasteners 54, such as rivets, screws or the like. By so securing the flap 50, an upper flap portion 56 and lower flap portion 58 simulate the action of flaps 46 and 48 of the first embodiment (FIGS. 1 and 2).

Figure 6:
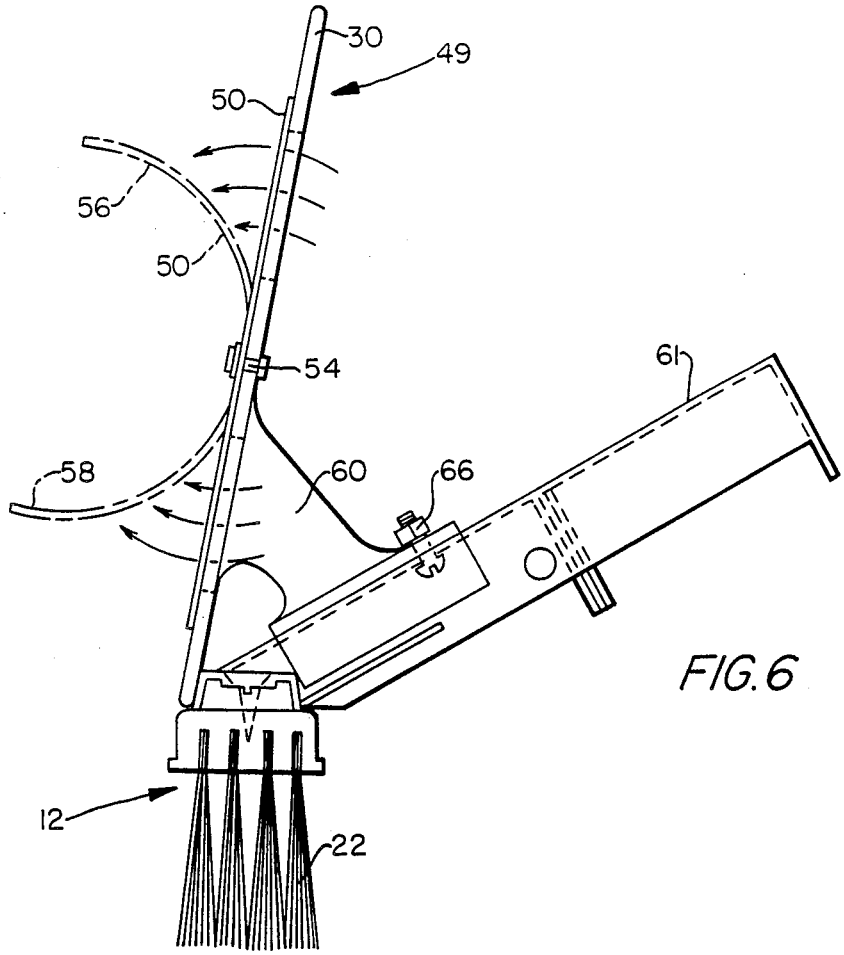
FIG. 6 is a side view of a second embodiment of the present invention.

FIG. 6 illustrates in phantom lines the displacement of flap sections 56 and 58 when the device of the second embodiment is pulled upwards through the water of a pool. Of course, when the device is pushed downwardly, the flap 50 will lie flat against the plane of plate 30, as shown in solid lines, in the same manner as previously explained in connection with the first embodiment of FIGS. 1 and 2.

FIG. 6 illustrates the utilization of web 60 for securing the foil device 49 of the second embodiment to a pole collar 61. A suitable fastener 66 may be employed to fasten web 60 to the collar.

Although the foil device of the present invention has been described in connection with a conventional pool brush, it is to be emphasized that its advantageous function may be equally used with other pool cleaning devices, such as a conventional pool vacuum cleaner head. It is also anticipated that the pool device of the present invention is preferably connected to a pole so that the latter may be selectively connected to either a pool brush or vacuum cleaner head and in each instance, the user is offered increased efficiency during a swimming pool cleaning operation.

It should be understood that the invention is not limited to the exact details of construction shown and described herein for obvious modifications will occur to persons skilled in the art.

I claim:

1. An attachment for increasing the cleaning efficiency of a pool cleaning device which has a pole for moving the device, the attachment comprising:

a foil connected to the pole for urging the device against a pool wall when the pole is pushed down through the water in the pool; and one-way valve means mounted to the foil for allowing flow through the foil when the pole is withdrawn from the water, thus minimizing water forces on the foil necessary for pole withdrawal.

2. The structure set forth in claim 1, wherein the valve means comprises at least one opening in the foil; and a corresponding flexible flap mounted to the foil for covering the opening when the pole is pushed down and uncovering the opening when the pole is withdrawn.

3. The structure set forth in claim 1, wherein the valve means comprises openings formed in the foil, in a plurality of rows; and a plurality of flaps mounted to the foil, each flap opening and closing the openings of a respective row.

4. The structure set forth in claim 1 wherein the valve means comprises at least two rows of openings; and a single flap centrally secured to the foil, between the rows, the flap having first and second sections for opening and covering the openings of a corresponding row.

5. The structure set forth in claim 3 wherein the pool cleaning device includes a brush member connected to the pole in proximity to the foil.

6. The structure set forth in claim 4, wherein the pool cleaning device includes a brush member connected to the pole in proximity to the foil.

7. The structure set forth in claim 3, wherein the pool cleaning device includes a vacuum cleaner head connected to the pole in proximity to the foil.

8. The structure set forth in claim 4, wherein the pool cleaning device includes a vacuum cleaner head connected to the pole in proximity to the foil.

* * * * *